US010711950B1

(12) United States Patent
Zeng et al.

(10) Patent No.: US 10,711,950 B1
(45) Date of Patent: Jul. 14, 2020

(54) LIGHT BULB BASE AND LIGHT BULB THEREOF

(71) Applicant: XIAMEN ECO LIGHTING CO. LTD., Xiamen (CN)

(72) Inventors: Mao Jin Zeng, Xiamen (CN); Liang Liang Cao, Xiamen (CN); Xiao Bo Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/359,387

(22) Filed: Mar. 20, 2019

(51) Int. Cl.

| | |
|---|---|
| ***F21K 9/232*** | (2016.01) |
| ***H01R 33/22*** | (2006.01) |
| ***F21V 29/70*** | (2015.01) |
| ***F21K 9/235*** | (2016.01) |
| ***F21V 17/10*** | (2006.01) |

(52) U.S. Cl.
CPC ..... *F21K 9/232* (2016.08); *F21K 9/235* (2016.08); *F21V 17/104* (2013.01); *F21V 29/70* (2015.01); *H01R 33/22* (2013.01)

(58) Field of Classification Search
CPC ..... F21K 9/232; F21K 9/235; F21V 17/104; F21V 17/002; F21V 17/005
See application file for complete search history.

(56) References Cited

U.S. PATENT DOCUMENTS

| | | | | |
|---|---|---|---|---|
| 9,151,451 | B2 * | 10/2015 | Yang | H01R 33/09 |
| 2010/0219735 | A1 * | 9/2010 | Sakai | F21V 23/002 313/46 |
| 2011/0133652 | A1 * | 6/2011 | Chen | F21V 19/001 315/112 |
| 2012/0127733 | A1 * | 5/2012 | Tomiyoshi | F21V 3/02 362/363 |
| 2015/0062929 | A1 * | 3/2015 | Mostoller | F21K 9/00 362/363 |
| 2015/0070910 | A1 * | 3/2015 | Yang | F21V 19/045 362/363 |
| 2015/0327349 | A1 * | 11/2015 | Lee | F21K 9/232 362/294 |
| 2015/0330580 | A1 * | 11/2015 | Reier | F21K 9/23 362/646 |
| 2020/0063922 | A1 * | 2/2020 | Wang | F21K 9/238 |

* cited by examiner

*Primary Examiner* — William N Harris
(74) *Attorney, Agent, or Firm* — Chun-Ming Shih; Lanway IPR Services

(57) ABSTRACT

A light bulb base includes a cylinder-shaped insulating component, a cylinder-shaped base connector, a metal thimble and a heat-dissipating component. The insulating component has a jack at its first side. The base connector has a circumferential interior bore extending there through. The interior bore accommodates the insulating component at a first side of the base connector. The metal thimble inserts into the jack at its first side via the interior bore. Such that the metal thimble rivets the base connector to the insulating component. The heat-dissipating component has a first side coupled to a second side of the insulating component. The heat-dissipating component includes a first opening at its second side. The heat-dissipating component also includes a cavity chamber disposed inside the first opening.

13 Claims, 5 Drawing Sheets

LIGHT BULB BASE AND LIGHT BULB THEREOF

BACKGROUND

1. Field of the Invention

The present invention relates to an illuminating device, and more particularly, to a light bulb base and a light bulb that utilizes the light bulb base.

2. Description of the Prior Art

A conventional LED light bulb consists of a metal threaded housing, an insulating plastic component, and a metal thimble. For fabricating the insulating plastic component, insulating plastic material is injected into a customized mold that encompasses the metal threaded housing, such that the insulating plastic component is formed within a space between the metal threaded housing and the mold. However, such fabrication is not efficient, and the customized mold is also expensive in its preparation. As a result, a cost of the conventional LED light bulb is inevitably and significantly raised.

On top of that, although the conventional insulating plastic component is capable of separating the metal threaded housing from the metal thimble, it is still vulnerable to any external force and is not capable of providing sufficient protection to the conventional LED light bulb. For improving protection to the conventional LED light bulb, the fabricator may thicken the metal threaded housing or apply metals having high hardness to fabricate the metal threaded housing. However, such measures definitely and further increase the cost of fabricating the conventional LED light bulb.

SUMMARY OF INVENTION

The present invention aims at disclosing a cost-effective light bulb base and a light bulb that incorporates the disclosed light bulb base. Both of the light bulb and the light bulb base can be fabricated efficiently. The disclosed light bulb base and the light bulb are capable of providing sufficient protection without thickening its metal housing. Also, the disclosed light bulb base and light bulb can be assembled in a simpler manner to achieve the abovementioned efficient fabrication.

According to one embodiment of the present invention, the disclosed light bulb base includes a cylinder-shaped insulating component, a cylinder-shaped base connector and a metal thimble. The cylinder-shaped insulating component has a jack at its first side. The cylinder-shaped base connector has a circumferential interior bore extending there through. The circumferential interior bore accommodates the cylinder-shaped insulating component at a first side of the cylinder-shaped base connector. The metal thimble inserts into the jack at its first side via the circumferential interior bore. Such that the metal thimble rivets the cylinder-shaped base connector to the cylinder-shaped insulating component. Both the cylinder-shaped base connector and the metal thimble are made of conductive materials. The cylinder-shaped insulating component separates the cylinder-shaped base connector and the metal thimble in a mutually-insulated manner.

In one example, a second side of the metal thimble is exposed.

In one example, the disclosed light bulb base further includes a heat-dissipating component, which is coupled to a second side of the cylinder-shaped insulating component.

In one example, the heat-dissipating component is further coupled to the second side of the cylinder-shaped insulating component to form an integrated structure.

In one example, the cylinder-shaped base connector further includes a circumferential threaded external sidewall.

In one example, the cylinder-shaped base connector further includes an internal threaded surface on the circumferential internal sidewall of the cylinder-shaped base connector. The cylinder-shaped insulating component further includes an external threaded surface. The internal threaded surface of the cylinder-shaped base connector is detachably secured with the external threaded surface of the cylinder-shaped insulating component to form a tongue-and-groove fit.

In one example, the metal thimble is a rivet.

In one example, the cylinder-shaped insulating component further includes a lateral opening. The cylinder-shaped base connector is electrically coupled to a driving circuit board, which is disposed within the circumferential interior bore of the cylinder-shaped insulating component via the lateral opening. The lateral opening is away from the metal thimble by a distance that keeps the cylinder-shaped insulating component and the metal thimble in a mutually-insulated manner.

In one embodiment, the disclosed light bulb includes a light bulb base, an illuminating plate, a lampshade and a driving circuit board. The light bulb base includes a cylinder-shaped insulating component, a cylinder-shaped base connector, a metal thimble and a heat-dissipating component. The cylinder-shaped insulating component has a jack at its first side. The cylinder-shaped base connector has a circumferential interior bore extending there through. The circumferential interior bore accommodates the cylinder-shaped insulating component at a first side of the cylinder-shaped base connector. The metal thimble inserts into the jack at its first side via the circumferential interior bore. Such that the metal thimble rivets the cylinder-shaped base connector to the cylinder-shaped insulating component. The heat-dissipating component has a first side coupled to a second side of the cylinder-shaped insulating component. The heat-dissipating component includes a first opening at its second side. The heat-dissipating component also includes a cavity chamber disposed inside the first opening. The illuminating plate is disposed at the first opening of the heat-dissipating component. The lampshade is coupled to the second side of the heat-dissipating component. The lampshade also covers the illuminating plate. The driving circuit board is disposed within the cavity chamber. The driving circuit board is electrically coupled to the illuminating plate. And the driving circuit board is electrically coupled to the metal thimble via the jack.

In one example, a second side of the metal thimble is exposed for electrically coupled to an external power source or ground.

In one example, the heat-dissipating component is further coupled to the second side of the cylinder-shaped insulating component to form an integrated structure.

In one example, the cylinder-shaped base connector further includes a circumferential threaded external sidewall.

In one example, the cylinder-shaped base connector further includes an internal threaded surface on the circumferential internal sidewall of the cylinder-shaped base connector.

In one example, the cylinder-shaped insulating component further includes an external threaded surface. The internal threaded surface of the cylinder-shaped base connector is detachably secured with the external threaded surface of the cylinder-shaped insulating component to form a tongue-and-groove fit.

In one example, the metal thimble is a rivet.

In one example, the cylinder-shaped insulating component further includes a lateral opening. The cylinder-shaped base connector is further electrically coupled to the driving circuit board via the lateral opening. The lateral opening is away from the metal thimble by a distance, which keeps the cylinder-shaped insulating component and the metal thimble in a mutually-insulated manner.

In one example, the cylinder-shaped base connector is further electrically coupled to an external power source or ground.

In one example, the heat-dissipating component further includes a partial-circumferentially projection at its second side.

In one example, the lampshade further includes a second opening and a circumferential ring projection that surrounds the second opening. The lampshade further includes a groove disposed on the circumferential ring projection. The groove detachably engages with the partial-circumferentially projection for engaging the lampshade with the heat-dissipating component.

In one example, a length of the groove is larger than a length of the partial-circumferentially projection on the circumferential ring projection.

In one example, the groove detachably engages with the partial-circumferentially projection by rotating the heat-dissipating component in a clockwise manner or in a counterclockwise manner towards the lampshade along an axial direction of the heat-dissipating component.

In one example, the lampshade is partially sphere-shaped.

In one example, the lampshade further covers the driving circuit board.

In one example, the illuminating plate further includes a screw through-hole. The heat-dissipating component further includes a screw hole disposed at its second side. And the light bulb further includes a screw, which screws through the screw through-hole and into the screw hole for screwing the illuminating plate to the heat-dissipating component.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, the present invention discloses a cost-effective light bulb that can be assembled in a simpler manner, in comparison to the conventional LED light bulb.

Figure 1:
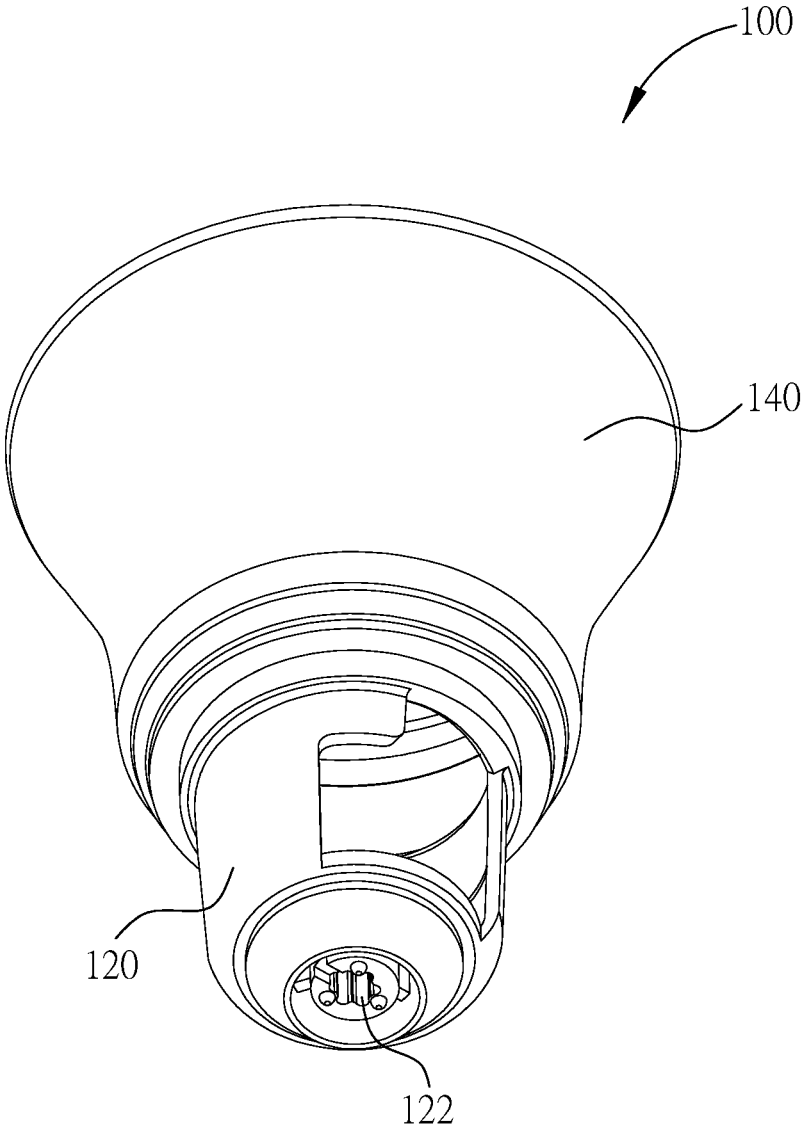
FIG. 1 illustrates a partial view of a light bulb base according to a first embodiment of the present invention.
Figure 2:
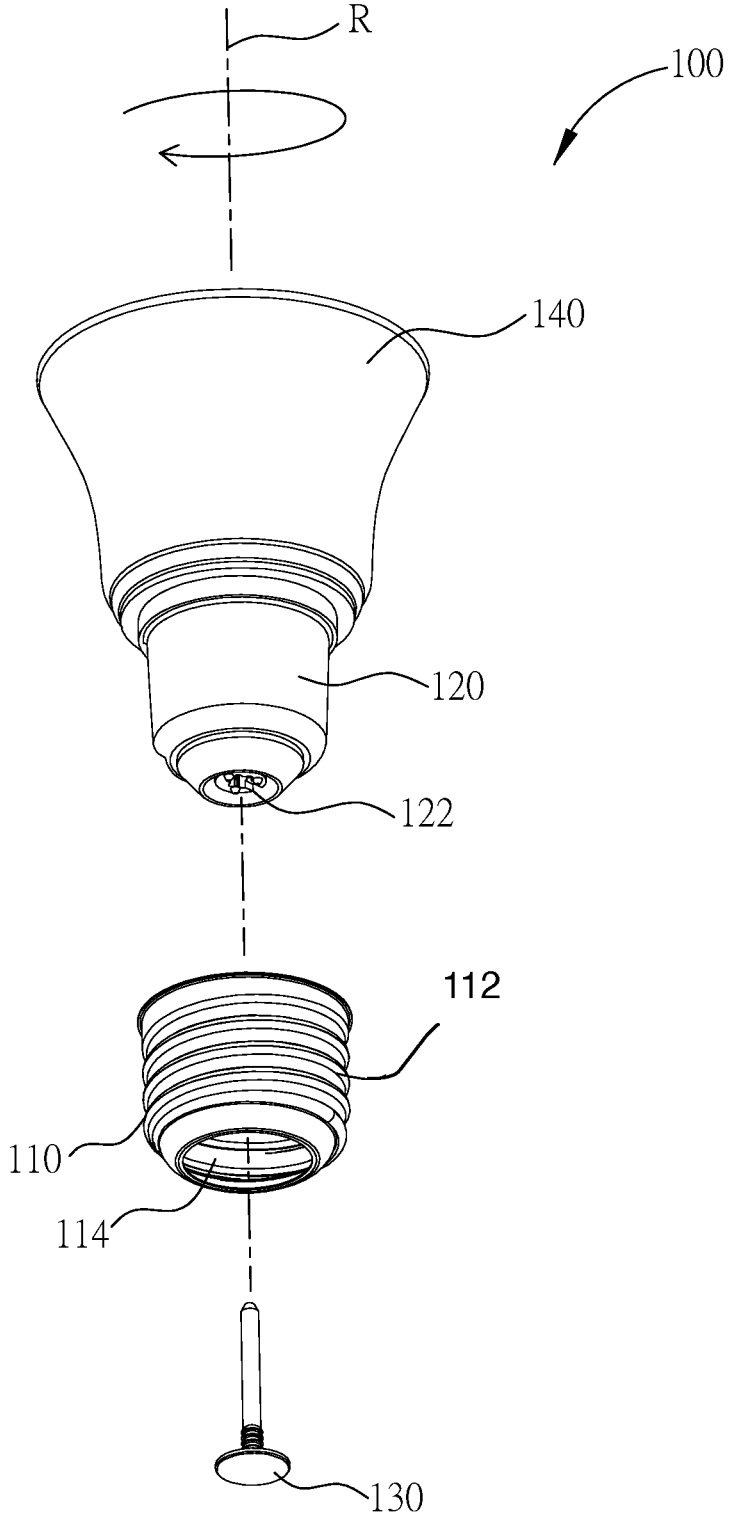
FIG. 2 also illustrates a split view of the light bulb base shown in FIG. 1 by splitting primary components of the light bulb base.

FIG. 1 illustrates a partial view of a light bulb base 100 according to a first embodiment of the present invention. The light bulb base 100 forms part of the light bulb disclosed in the present invention. FIG. 2 also illustrates a split view of the light bulb base 100 by splitting primary components of the light bulb base 100. The light bulb base 100 includes at least a base connector 110, an insulating component 120, and a metal thimble 130. In FIG. 1, the insulating component 120 is illustrated in a partially perspective view. In one example, both the base connector 110 and the insulating component 120 are cylinder-shaped.

The base connector 110 has a circumferential interior bore 114 that extends through the base connector 110. The interior bore 114 is capable of accommodating the insulating component 120 at a first side of the base connector 110, which is an upper side of the base connector in view of FIG. 2.

In one example, an internal sidewall of the base connector 110 is in contact with an external surface of the insulating component 120 when the base connector 110 accommodates the insulating component 120. In one example, the internal sidewall of the base connector 110 is a threaded surface, and the external surface of the insulating component 120 is also a threaded surface. Also, in one example, the threaded internal sidewall of the base connector 110 can be detachably secured with the threaded external surface of the insulating component 120 to form a tongue-and-groove fit.

The insulating component 120 has a jack 122 at its first side, which is a bottom side of the insulating component 120 in view of FIG. 2. After the base connector 110 accommodates the insulating component 120, the metal thimble 130 inserts into the jack 122 at its first side via the interior bore 114, i.e., inserted into the insulating component 120. The first side of the metal thimble 130 may be its upper side in view of FIG. 2. After the metal thimble 130 inserts into the jack 122, the metal thimble 130 rivets the base connector 110 to the insulating component 120. In one example, both the base connector 110 and the metal thimble are made of conductive materials, such as conductive metals. With the aid of such interaction between the base connector 110, the insulating component 120 and the metal thimble 130, the base connector 110 and the metal thimble 130 are well separated by the insulating component 120 in a mutually-insulated manner. In other words, when the light bulb base 100 is operated and conducted with currents, a current flowing through the base connector 110 does not interfere a current flowing through the metal thimble 130, and vice versa. Without such insulation between the base connector 110 and the metal thimble 130, operations of the light bulb base 100 may be sabotaged by wrongly conductive interference between the base connector 110 and the metal thimble 130.

On top of that, the insulating component 120 provides additional physical support for the base connector 110 via the contact between the external surface of the insulating component 120 and the inner sidewall of the base connector 110. With the aid of the insulating component 120's additional support, a whole strength of the light bulb base 100 is significantly increased.

In this way, the base connector 110 can be made of a conductive metal that is more flexible. In other words, the light bulb base 100 is more cost-effective by applying such flexible conductive metal in the base connector 110. Besides, the process of assembling the base connector 110 to the light bulb base 100 is getting easier and more error-tolerable. As a result, the light bulb base 100 is capable of passing external pressure tests in an easier manner because of its increased strength supported by the insulating component 120.

In one example, the metal thimble 130 is exposed at its second side, which is a lower side of the metal thimble 130 in view of FIG. 2, such that the metal thimble 130 is capable of electrically connected to an external power source.

In one example, the metal thimble 130 is a rivet that rivets the base connector 110 to the insulating component 120.

In one example, the light bulb base 100 additionally includes a heat-dissipating component 140 for dissipating heats generated by the light bulb base 100 under operation. The heat-dissipating component 140 is coupled to the insulating component 120 at its second side to the base connector 110, where the insulating component 120's second side is a top side of the insulating component 120 in view of FIG. 2.

In one example, the heat-dissipating component 140 can be coupled to the insulating component 120 to form an integrated structure. In this way, the cost and the complexity of preparing two different molds for fabricating the heat-dissipating component 140 and the insulating component 120 are significantly reduced. In other words, only one mold is required to fabricate the integrated structure that incorporates both the heat-dissipating component 140 and the insulating component 120.

In one example, the base connector 110 has a circumferential external threaded surface 112 that can be electrically coupled to an external power source, which has a threaded socket for engaging with the base connector 110 on the external threaded surface. In another example, under the condition that the metal thimble 130 is also electrically coupled to another power source, one of the power sources may be a positive DC voltage source, whereas the other one power source may be a negative voltage source or a ground voltage source. In this way, the light bulb incorporating the light bulb base 100 illuminates with the aid of both the external power sources.

Figure 3:
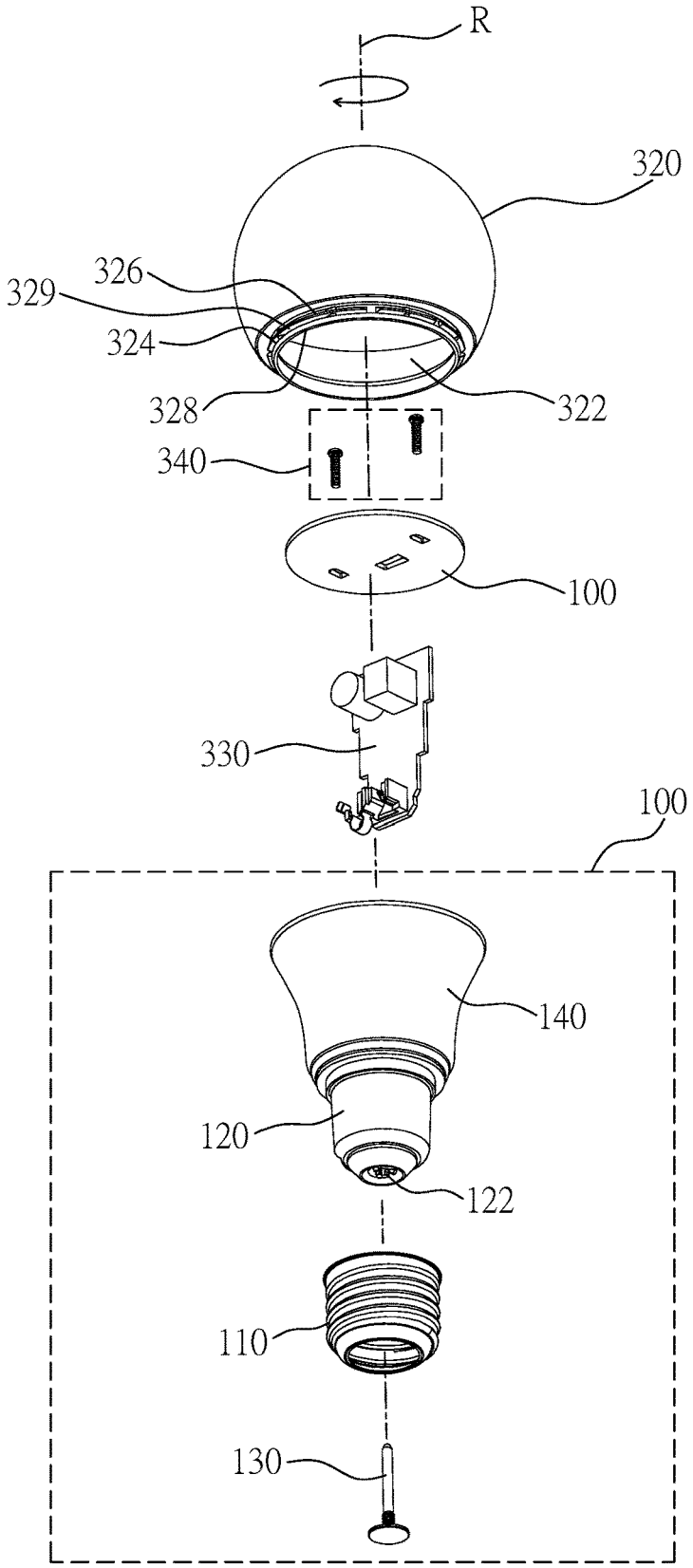
FIG. 3 illustrates a split view of a light bulb according to one example of the present invention.
Figure 4:
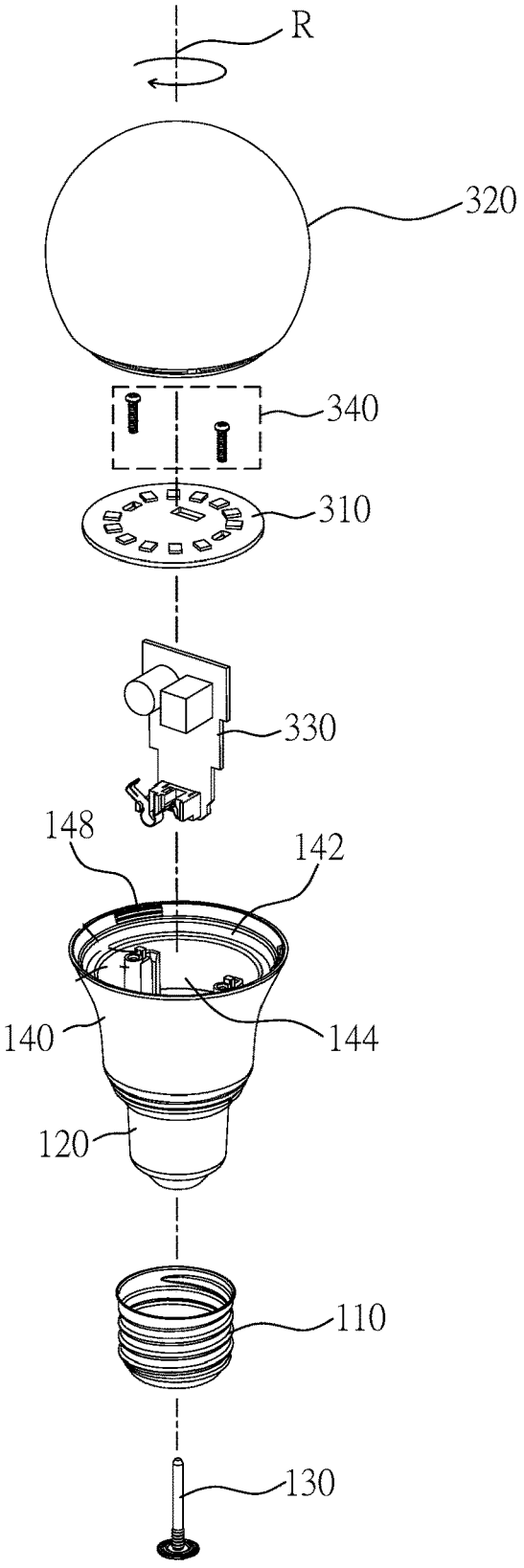
FIG. 4 illustrates a split view of the light bulb shown in FIG. 4 according to one example of the present invention.
Figure 5:
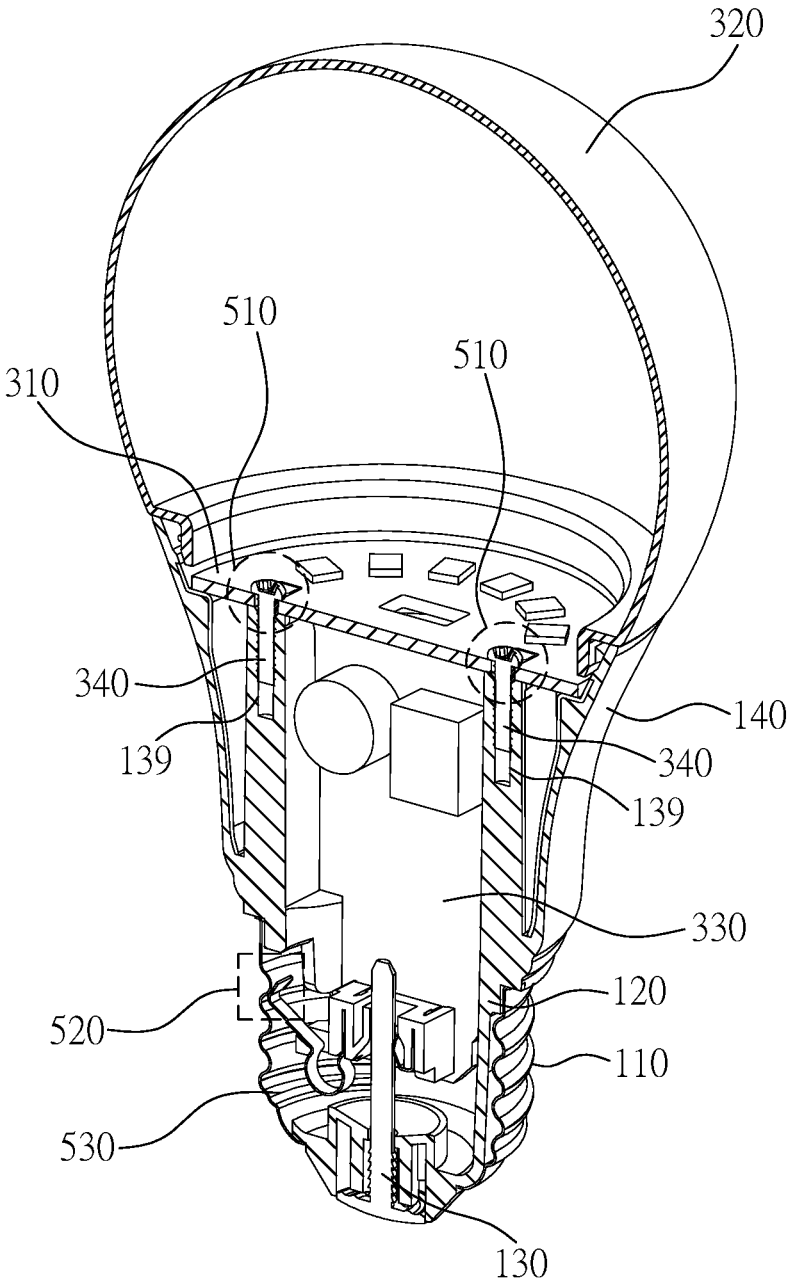
FIG. 5 illustrates a perspective view of the light bulb shown in FIGS. 3-4 according to one example of the present invention.

FIG. 3, FIG. 4, FIG. 5 illustrate a light bulb that incorporates the light bulb base 100 shown in FIGS. 1-2 according to a second embodiment of the present invention. FIG. 3 illustrates a split view of the light bulb according to one example of the present invention. FIG. 4 illustrates a split view of the light bulb according to one example of the present invention. FIG. 5 illustrates a perspective view of the light bulb according to one example of the present invention.

The light bulb includes the light bulb base 100 shown in FIGS. 1-2, and further includes an illuminating plate 310, a lampshade 320 and a driving circuit board 330.

More specifically, in one example, the heat-dissipating component 140 further includes an opening 142 at its second side and further includes a cavity chamber 144 disposed inside the opening 142.

The illuminating plate 310 is disposed at the opening 142. And the illuminating plate 310 illuminates while being powered up. In one example, the illuminating plate 310 includes at least one light emitting diode arranged in various formations and/or on various locations thereon.

The lampshade 320 has one side coupled to the second side of the heat-dissipating element 140, for example, the upper side as shown in FIG. 4. The lampshade 320 also covers the illuminating plate 310 to provide sufficient protection and to adjust the illuminating plate 310's luminance to a certain degree.

The driving circuit board 330 is disposed within the cavity chamber 144. Also, the driving circuit board 330 is electrically coupled to the illuminating plate 310. In this way, the driving circuit board 330 is capable of powering up the illuminating plate 310 for illuminating purposes. Specifically, the driving circuit board 330 is also electrically coupled to the metal thimble 130 via the jack 122, as illustrated in FIG. 5, for conducting to an external power source or ground that is electrically coupled to the metal thimble 130.

In one example, as shown in FIG. 5, the insulating component 120 may further include a lateral opening 520 and even a conductive wiring 530. And the base connector 110 may be electrically coupled to the driving circuit board 330 via the opening 520 and even the conductive wiring 530. In this way, the driving circuit board 330 may also be capable of electrically coupled to an external source or ground that is electrically coupled to the base connector 110. Specifically, for substantially keeping the base connector 110 and the metal thimble 130 in a mutually-insulated manner, the lateral opening 520 and even the conductive wiring 530 are disposed away from the metal thimble 130.

In one example, as shown in FIG. 4, the heat-dissipating component 140 further includes an inward partially-circumferential projection 148 at its second side. Also, as shown in FIG. 3, the lampshade 320 further includes an opening 322 and a circumferential ring projection 328. The circumferential ring projection 328 surrounds the opening 322 and includes at least one groove, e.g., a groove 329 disposed on the circumferential ring projection 328 and illustrated in FIG. 3.

In one example, the groove 329 is defined by at least two limiters, e.g., limiters 326 and 324 as shown in FIG. 3. The groove 329 detachably engages with the inward partially-circumferential projection 148, such that the lampshade 320 can detachably engages with the heat-dissipating component 140. In one example, a length of the groove 329 is larger than a length of the inward partially-circumferential projection 148, such that the lampshade 320 can be detachably engages with the heat-dissipating component 140 in an easier manner. In one example, when one of the lampshade 320 or the heat-dissipating component 140 is rotated toward the other along an axis R, either in a clockwise manner or in a counterclockwise manner, the groove 329 detachably engages with the inward partially-circumferential projection 148 for completing the detachable engagement between the lampshade 320 and the heat-dissipating component 140. The axis R is as illustrated in FIGS. 2-4.

In one example, the lampshade 320 is partially sphere-shaped, as illustrated in FIGS. 3-5.

In one example, the lampshade 320 also covers the driving circuit board 330 along with the illuminating plate 310.

In one example, the illuminating plate 310 further includes at least one screw through-hole, e.g. at least one screw through-hole 510 shown in FIG. 5. Also, the heat-dissipating component 140 includes at least one screw hole at its second side, e.g., at least one screw hole 139 shown in FIG. 5. In addition, the light bulb includes at least one screw 340 that screws through both the at least one screw through-hole 510 and the at least one screw hole 139. In this way, the illuminating plate 310 and even the driving circuit board 330 can be better affixed to the heat-dissipating plate 140 by screwing.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A light bulb, comprising:

a light bulb base, comprising:

a cylinder-shaped insulating component, having a jack at its first side;

a cylinder-shaped base connector, having a circumferential interior bore extending there through, and the circumferential interior bore is configured to accommodate the cylinder-shaped insulating component at a first side of the cylinder-shaped base connector;

a metal thimble, configured to insert into the jack at its first side via the circumferential interior bore, such that the metal thimble rivets the cylinder-shaped base connector to the cylinder-shaped insulating component; and a heat-dissipating component, having a first side coupled to a second side of the cylinder-shaped insulating component, the heat-dissipating component comprises a first opening at its second side and comprises a cavity chamber disposed inside the first opening;

an illuminating plate, disposed at the first opening of the heat-dissipating component;

a lampshade, coupled to the second side of the heat-dissipating component and configured to cover the illuminating plate; and a driving circuit board, disposed within the cavity chamber, electrically coupled to the illuminating plate, and electrically coupled to the metal thimble via the jack, wherein the heat-dissipating component further comprises an inward partially-circumferential prosection at its second side;

wherein the lampshade further comprises a second opening and a circumferential ring projection that surrounds the second opening, and further comprises a groove disposed on the circumferential ring projection; and wherein the groove is configured to detachably engage with the inward partial-circumferentially projection for engaging the lampshade with the heat-dissipating component.

2. The light bulb of claim 1, wherein a second side of the metal thimble is exposed for being electrically coupled to an external power source or ground.

3. The light bulb of claim 1, wherein the heat-dissipating component is further coupled to the second side of the cylinder-shaped insulating component to form an integrated structure.

4. The light bulb of claim 1, wherein the cylinder-shaped base connector further comprises a circumferential threaded external sidewall.

5. The light bulb of claim 1, wherein the cylinder-shaped base connector further comprises an internal threaded surface on a circumferential internal sidewall of the cylinder-shaped base connector;

wherein the cylinder-shaped insulating component further comprises an external threaded surface; and wherein the internal threaded surface of the cylinder-shaped base connector is configured to be detachably secured with the external threaded surface of the cylinder-shaped insulating component to form a tongue-and-groove fit.

6. The light bulb of claim 1, wherein the metal thimble is a rivet.

7. The light bulb of claim 1, wherein the cylinder-shaped insulating component further comprises a lateral opening, and the cylinder-shaped base connector is further configured to be electrically coupled to the driving circuit board via the lateral opening; and wherein the lateral opening is away from the metal thimble by a distance that keeps the cylinder-shaped base connector and the metal thimble in a mutually-insulated manner.

8. The light bulb of claim 7, wherein the cylinder-shaped base connector is further electrically coupled to an external power source or ground.

9. The light bulb of claim 1, wherein a length of the groove is larger than a length of the inward partial-circumferentially projection on the circumferential ring projection.

10. The light bulb of claim 1, wherein the groove is configured to detachably engage with the partial-circumferentially projection by rotating the heat-dissipating component in a clockwise manner or in a counterclockwise manner towards the lampshade along an axial direction of the heat-dissipating component.

11. The light bulb of claim 1, wherein the lampshade is partially sphere-shaped.

12. The light bulb of claim 1, wherein the lampshade is further configured to cover the driving circuit board.

13. The light bulb of claim 1, wherein the illuminating plate further comprises a screw through-hole, the heat-dissipating component further comprises a screw hole disposed at its second side; and wherein the light bulb further comprises a screw, configured to screw through the screw through-hole and into the screw hole, for screwing the illuminating plate to the heat-dissipating component.

* * * * *